United States Patent [19]

Ladner, Sr. et al.

[11] Patent Number: 5,014,661

[45] Date of Patent: May 14, 1991

[54] AUTOMOTIVE THERMAL BREAKER APPARATUS

[76] Inventors: John C. Ladner, Sr.; June C. Ladner, both of Rt 4, Box 354, Poplarville, Miss. 39470

[21] Appl. No.: 550,067

[22] Filed: Jul. 9, 1990

[51] Int. Cl.[5] ..... F02B 77/00

[52] U.S. Cl. ..... 123/198 D; 123/41.15

[58] Field of Search ..... 123/91.15, 198 D, 198 DC; 337/380, 397, 398

[56] References Cited

U.S. PATENT DOCUMENTS 2,332,212 10/1943 Fillo ..... 337/397

2,930,365 3/1960 Muscato ..... 123/41.15

*Primary Examiner*—Noah P. Kamen

*Attorney, Agent, or Firm*—Leon Gilden

[57] ABSTRACT

An apparatus including a housing containing a first and second conductive plate overlapping one another, with the second plate pivotally positionable relative to the first plate to disengage and space the second plate relative to the first plate to disengage electrical communication therebetween, wherein the first plate is in electrical communication with the coil of an automotive engine and wherein the second plate is in electrical communication with the ignition in operative association directing flow of current to the coil. A sealed secondary housing is mounted within the above noted housing and includes a fixed rod mounted to and through a floor of the housing, with the rod in operative communication with a coolant water jacket of an associated internal combustion engine. The sealed secondary housing includes a bi-metallic coupler therebetween, whereupon elevated temperature within the water jacket directs a reciprocatable rod outwardly relative to the secondary housing to effect displacement of the second plate relative to the first plate upon sensing of elevated coolant temperatures within the aforenoted water jacket.

2 Claims, 2 Drawing Sheets

AUTOMOTIVE THERMAL BREAKER APPARATUS

BACKGROUND OF THE INVENTION

1. Field of the Invention

The field of invention relates to detection apparatus, and more particularly pertains to a new and improved automotive thermal breaker apparatus in operative association with an automotive engine working environment to effect a shut-down of the associated internal combustion engine of the automobile upon sensing of elevated engine operating temperatures.

2. Description of the Prior Art

The use of various detection equipment in cooperative association with an automotive environment is utilized in the prior art. Typically such devices are in the form of gauges to monitor various engine functions, such as oil pressure, water temperature, and the like. While disabling structure is utilized in the prior art to effect operative disengagement of an automotive engine to prevent harm thereto, such organizations are typically of a relatively complex and elaborate construction and accordingly have enjoyed relatively minimal acceptance within the automotive community. Examples of prior art devices include U.S. Pat. No. 4,648,364 to Wills utilizing an engine protection apparatus to monitor various engine functions, as well as a disabling circuit to effect shut-down of the automobile in use.

U.S. Pat. No. 4,136,329 to Trobert sets forth an engine condition responsive shut-down and warning apparatus in response to a variety of signals, as well as an over-ride to permit restart of the organization to provide a driver of the automobile of additional time.

U.S. Pat. No. 4,231,073 to Suchko sets forth an improved engine control system to effect shut-down of an internal combustion engine and monitor the engine for fault conditions.

U.S. Pat. No. 4,327,352 to Cerruti provides a monitoring apparatus to monitor various engine functions of an associated automobile.

U.S. Pat. No. 4,485,772 is a further example of an engine stop-restart system, wherein the engine is automatically stopped under predetermined conditions and thereafter automatically started after a further set of conditions have been effected and is another example of a typical prior art device and associated circuitry for effecting such events.

As such, it may be appreciated that there continues to be a need for a new and improved automotive thermal breaker apparatus wherein the same sets forth a compact and convenient breaker system to effect a shut-down of an associated automotive engine upon elevated temperatures being detected by the organization and in this respect, the present invention substantially fulfills this need.

SUMMARY OF THE INVENTION

In view of the foregoing disadvantages inherent in the known types of engine monitoring apparatus now present in the prior art, the present invention provides an automotive thermal breaker apparatus wherein the same effects disruption of electrical communication with the automotive engine upon elevated temperatures being detected within the coolant system of the associated automobile engine. As such, the general purpose of the present invention, which will be described subsequently in greater detail, is to provide a new and improved automotive thermal breaker apparatus which has all the advantages of the prior art automotive engine monitoring apparatus and none of the disadvantages.

To attain this, the present invention provides an apparatus including a housing containing a first and second conductive plate overlapping one another, with the second plate pivotally positionable relative to the first plate to disengage and space the second plate relative to the first plate to disengage electrical communication therebetween, wherein the first plate is in electrical communication with the coil of an automotive engine and wherein the second plate is in electrical communication with the ignition in operative association directing flow of current to the coil. A sealed secondary housing is mounted within the above noted housing and includes a fixed rod mounted to and through a floor of the housing, with the rod in operative communication with a coolant water jacket of an associated internal combustion engine. The sealed secondary housing includes a bi-metallic coupler therebetween, whereupon elevated temperature within the water jacket directs a reciprocatable rod outwardly relative to the secondary housing to effect displacement of the second plate relative to the first plate upon sensing of elevated coolant temperatures within the aforenoted water jacket.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved automotive thermal breaker apparatus which has all the advantages of the prior art automotive engine monitoring apparatus and none of the disadvantages.

It is another object of the present invention to provide a new and improved automotive thermal breaker apparatus which may be easily and efficiently manufactured and marketed.

It is a further object of the present invention to provide a new and improved automotive thermal breaker apparatus which is of a durable and reliable construction.

An even further object of the present invention is to provide a new and improved automotive thermal breaker apparatus which is susceptible of a low cost of manufacture with regard to both materials and labor, and which accordingly is then susceptible of low prices of sale to the consuming public, thereby making such automotive engine breaker apparatus economically available to the buying public.

Still yet another object of the present invention is to provide a new and improved automotive thermal breaker apparatus which provides in the apparatuses and methods of the prior art some of the advantages thereof, while simultaneously overcoming some of the disadvantages normally associated therewith.

Still another object of the present invention is to provide a new and improved automotive thermal breaker apparatus wherein the same effects a shut-down of an engine upon detection of elevated engine operating conditions.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
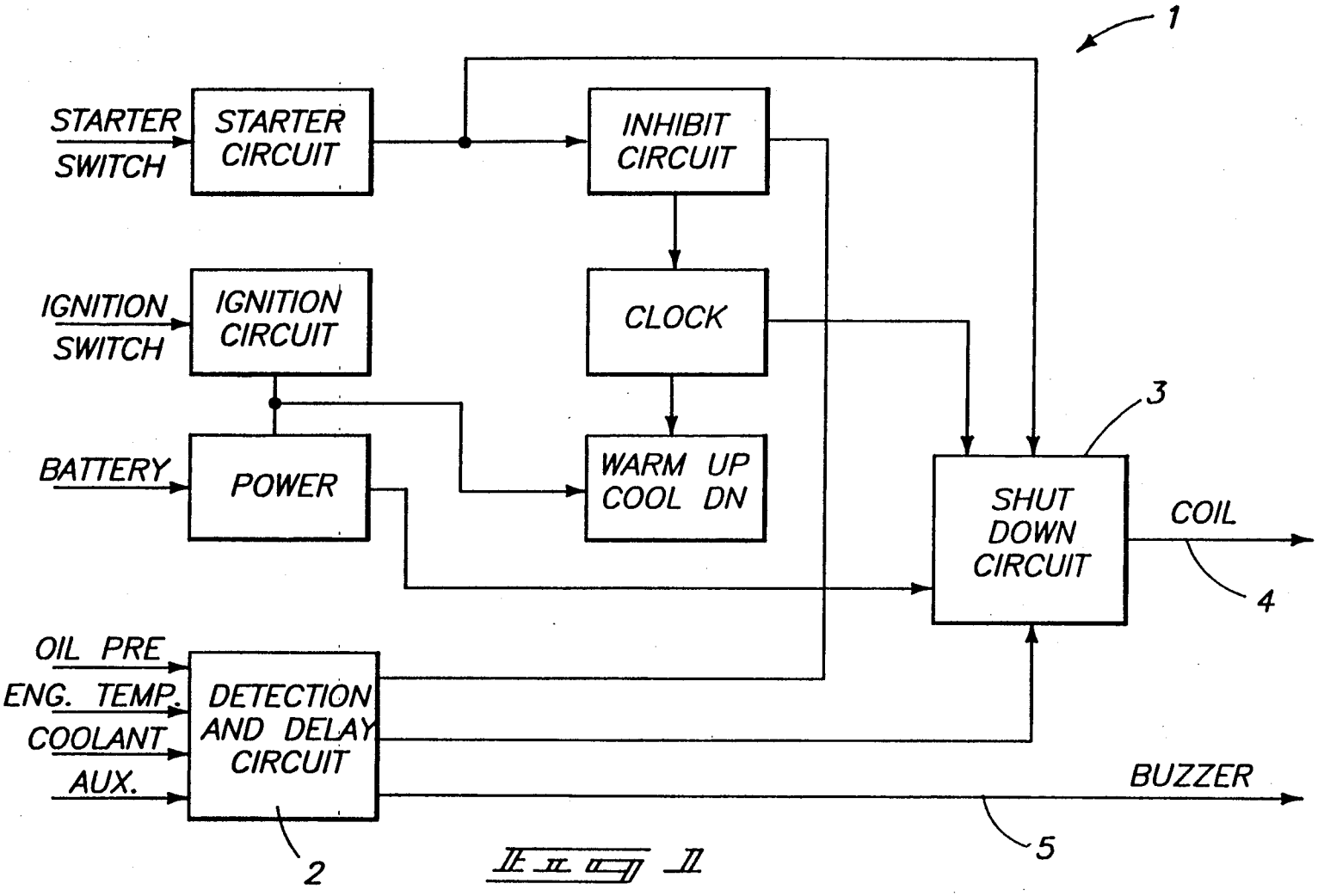
FIG. 1 is a diagrammatic illustration of a prior art engine monitoring and shut-down organization.
Figure 2:
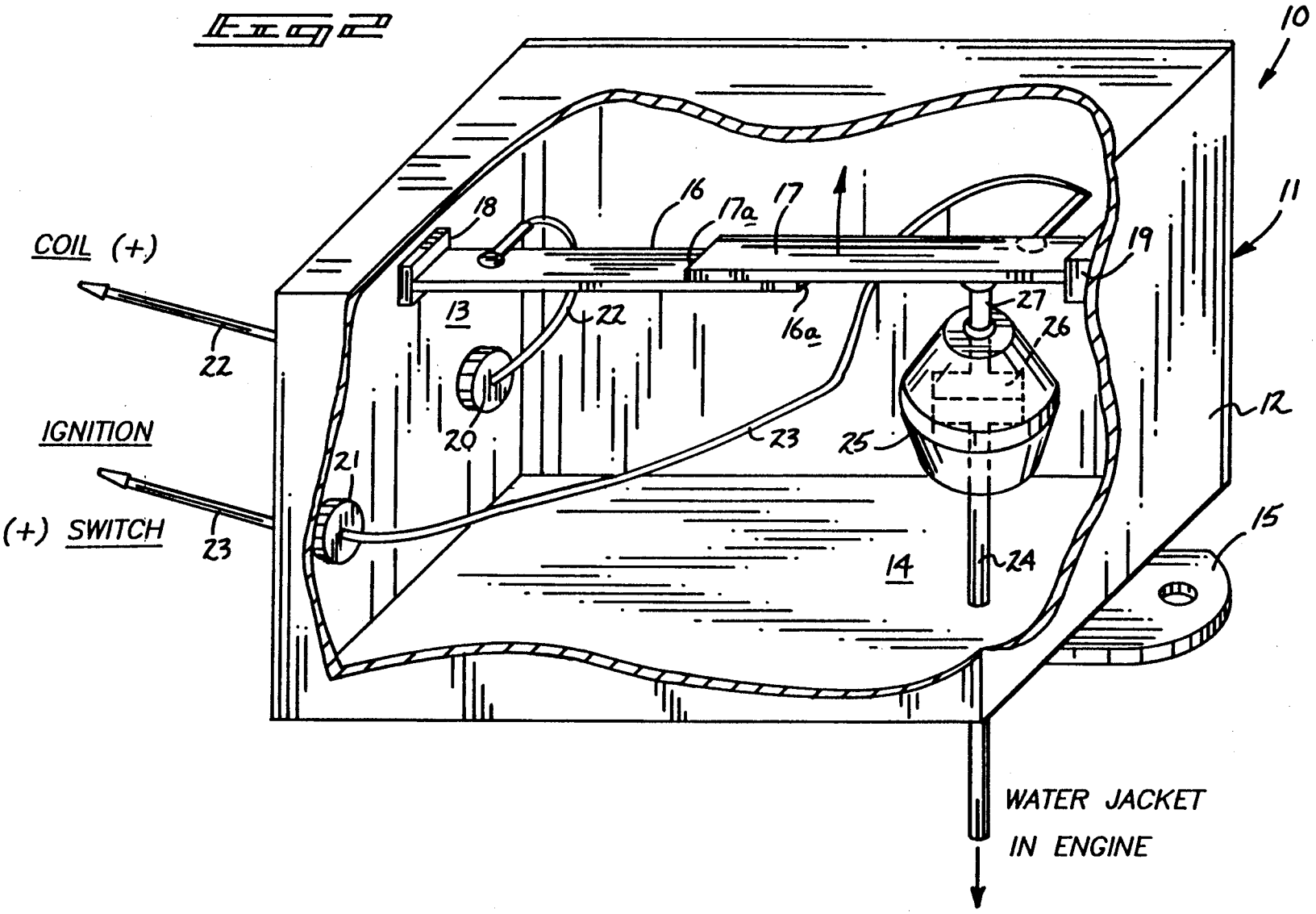
FIG. 2 is an isometric illustration of the instant invention.

With reference now to the drawings, and in particular to FIGS. 1 and 2 thereof, a new and improved automotive thermal breaker apparatus embodying the principles and concepts of the present invention and generally designated by the reference numeral 10 will be described.

FIG. 1 illustrates a prior art monitoring apparatus 1, wherein a detection circuit 2 in operative association with a variety of engine impulse systems include engine temperature and the like and effects an audible alarm 5, as well as disengagement of the coil circuit 4 associated with the coil of the automobile engine.

More specifically, the automotive thermal breaker apparatus 10 of the instant invention essentially comprises a housing 11 including a first side wall 12 spaced from a second side wall 13, including a floor 14, as well as a forward and rear wall and a roof to define an enclosed housing. A mounting flange 15 is mounted to the housing relative to the floor 14 and first side wall to permit effective mounting of the organization relative to an engine compartment of an associated automotive environment. The mounting flange 15 permits mounting upon any available support surface relative to an associated engine compartment, as is convenient. A first conductive rigid plate 16 is mounted to the second side wall 13 by a first insulative mount 18 to electrically insulate the first plate 16 relative to the housing. A second conductive rigid plate 17 is mounted to the first side wall 12 by a second insulative mount 19, wherein the second insulative mount is flexible and permits flexure and displacement of the second plate relative to the first plate and the housing 11. The first plate 16 includes a first plate forward end **16*a*, wherein the second plate 17 includes a second plate forward end 17*a*, wherein the first and second forward ends 16*a* and 17*a* respectively are displaced relative to one another to effect electrical communication between the first and second plates as they are in an overlapped and aligned configuration, as illustrated in FIG. 2. The second wall 13 includes a first insulative grommet 20 and a second insulative grommet 21 directed therethrough, wherein the first insulated grommet 20 receives a first electrically conductive wire 22 therethrough, while the second grommet 21 receives a second electrically conductive wire 23 therethrough. The first electrically conductive wire 22 is in electrical communication with the first plate 16 at one end, and in electrical communication with a coil member of an associated automobile at its remote end, while the second conductive wire 23 is in electrical communication with the second plate 17 at a first end and with a source of electrical transmission from the ignition switch system of the automobile at its second end to direct a current of electrical energy, typically twelve volts and a twelve volt system, to an associated coil of the automobile, wherein the first and second plates are in a contacting first position in contiguous relationship relative to one another, as illustrated in FIG. 2. A sealed secondary housing 25 includes a fixed sensor rod 24 mounted within the sealed housing 25 and fixedly mounted to the floor 14 and extending therethrough, wherein a remote terminal end of the fixed sensor rod is in fluid communication with the water jacket of an associated internal combustion engine. The sealed secondary housing 25 includes a bimetallic coupler 26 therewithin, wherein the bi-metallic coupler 26 receives a thermal signal from the sensor rod 24 and includes a reciprocatable rod 27 mounted reciprocatably relative to the bimetallic coupler 26 and the secondary housing 25, whereupon sensing of elevated temperatures within the associated automotive coolant jacket effects outward projection of the rod 27 relative to the sealed secondary housing 25 and effects displacement of the second conductive plate 17 relative to the first plate 16** and disengages electrical communication between the associated ignition system and coil and effects a shut-down of an associated automotive engine thereby to prevent damage to the engine due to elevated coolant temperatures.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An automotive thermal breaker apparatus comprising, in combination, a housing, the housing including a first switch plate, and a second switch plate, the first and second switch plates arranged for electrical communication in a first position and in a non-conductive electrical association in a second position, the first and second switch plates mounted within the housing, and the first switch plate in electrical communication with an automotive engine coil, and the second switch plate in electrical communication with an automotive engine ignition to direct electrical current to the engine coil when the first and second switch plates are in the first position, and a temperature sensor arranged for communication with a water jacket of an internal combustion engine to effect relative displacement of the second switch plate relative to the first switch plate to the second position, and wherein the housing includes a first side wall, a spaced second side wall, and a floor, the first switch plate mounted to the first side wall and including a first insulative mount to electrically isolate the first switch plate relative to the first side wall and the housing, and the second switch plate mounted to the second side wall, including a second insulative mount, wherein the second insulative mount is of a flexible memory retentent material to permit deflection of the second switch plate relative to the first switch plate, and wherein a first electrically conductive wire is in electrical association with the first switch plate and is directed through the housing to the coil, and a second electrically conductive wire is in electrical communication with the second switch plate and is directed through the housing to the automotive ignition, and the first and second switch plates are in contiguous overlapped relationship in the first position, and wherein the temperature sensor includes a sealed secondary housing, the sealed secondary housing includes a fixed sensor rod mounted to the floor of the housing and directed exteriorly of the housing in communication with the water jacket of the engine, and the secondary housing including a bi-metallic coupler mounted therewith, and the bi-metallic coupler including a reciprocatable rod mounted to the bi-metallic coupler, and the bi-metallic rod reciprocatably mounted within the secondary housing and extendible from a first rod positioned when the rod is attracted within the secondary housing to a second arm position when the rod is extended relative to the housing, and the reciprocatable rod mounted to the second switch plate at a forward end of the reciprocatable rod remote from the secondary housing to effect displacement of the second switch plate relative to the first switch plate when the reciprocatable rod is in the second rod position.

2. An apparatus as set forth in claim 1 including a mounting flange mounted to the housing to permit mounting of the housing to a support surface relative to the automotive engine.

* * * * *